US007560171B2

(12) United States Patent
Shiraishi et al.

(10) Patent No.: US 7,560,171 B2
(45) Date of Patent: Jul. 14, 2009

(54) COMPOSITE MATERIAL MEMBER AND METHOD FOR PRODUCING THE SAME

(75) Inventors: Toru Shiraishi, Yokohama (JP); Akihiro Katsuya, Yokohama (JP)

(73) Assignee: NHK Spring Co., Ltd., Yokohama (JP)

( * ) Notice: Subject to any disclaimer, the term of this patent is extended or adjusted under 35 U.S.C. 154(b) by 292 days.

(21) Appl. No.: 10/537,808

(22) PCT Filed: Dec. 2, 2003

(86) PCT No.: PCT/JP03/15392

§ 371 (c)(1),
(2), (4) Date: Jun. 7, 2005

(87) PCT Pub. No.: WO2004/052573

PCT Pub. Date: Jun. 24, 2004

(65) Prior Publication Data

US 2006/0037729 A1 Feb. 23, 2006

(30) Foreign Application Priority Data

Dec. 10, 2002 (JP) ..... 2002-358654

(51) Int. Cl.
*B32B 15/00* (2006.01)
*B32B 5/18* (2006.01)
*B32B 7/00* (2006.01)
*B22D 19/00* (2006.01)

(52) U.S. Cl. ..... 428/615; 428/608; 428/613; 428/649; 428/653; 164/98

(58) Field of Classification Search ..... 164/98, 164/76.1; 428/66.2, 613, 615, 608, 609, 428/307.7, 311.11, 312.8, 649, 652, 653, 428/621

See application file for complete search history.

(56) References Cited

FOREIGN PATENT DOCUMENTS

| | | | |
|---|---|---|---|
| JP | A 2-084243 | | 3/1990 |
| JP | A 5-177336 | | 7/1993 |
| JP | U-05-071474 | | 9/1993 |
| JP | A-06-106329 | | 4/1994 |
| JP | A-06-218519 | | 8/1994 |
| JP | 7-232261 | * | 9/1995 |

(Continued)

OTHER PUBLICATIONS

Partial-English Translation of paragraph [0023] of JP-A-232261, originally submitted in Information Disclosure Statement filed Jun. 7, 2005.

*Primary Examiner*—Kevin P Kerns
(74) *Attorney, Agent, or Firm*—Oliff & Berridge, PLC

(57) ABSTRACT

A composite material member is made of a light metal, and strength and durability in a joined part between constituent materials of the composite material member are improved, and production cost is decreased. The composite material member of the present invention contains a main material composed of a light metal or a light metal alloy which can be molded by casting; and a secondary material composed of a metallic material different from the main material or an inorganic material, the secondary material being joined to the main material by integrally casting with the main material, wherein a porous material is arranged on a part of a boundary area or entire boundary area between the main material and the secondary material.

5 Claims, 4 Drawing Sheets

FOREIGN PATENT DOCUMENTS

| | | | |
|---|---|---|---|
| JP | A-07-232261 | | 9/1995 |
| JP | 8-86324 | * | 4/1996 |
| JP | 08086324 | * | 4/1996 |
| JP | A-08-086324 | | 4/1996 |
| JP | A-08-229663 | | 9/1996 |
| JP | A 10-128521 | | 5/1998 |
| JP | B2-3176833 | | 4/2001 |
| WO | WO 00/32335 | | 6/2000 |

* cited by examiner

COMPOSITE MATERIAL MEMBER AND METHOD FOR PRODUCING THE SAME

TECHNICAL FIELD

The present invention relates to a composite material member composed of a light metal of a light metal alloy (hereinafter, "main material") used in engine blocks for automobiles, piston, parts for aircraft, and radiator plates for electronic devices, and to a secondary material which is different from the main material, and specifically relates to a technique in which strength and durability in a joined part between constituent materials of a composite material member are improved and production cost is decreased.

BACKGROUND ART

Recently, in order to respond to a demand for weight reduction in automobile parts and aircraft parts, light metals such Al alloys are often used. However, when a light metal is used, generally, it is necessary to combine the light metal with a secondary material which can provide the required characteristics, so as to compensate for problems in characteristics in the light metal, such as strength at elevated temperature, wear resistance and coefficient of thermal expansion (see Japanese Laid-open Utility Model No. 5-71474, specification (Page 1)).

In the combining, while there was an advantage in obtaining the characteristics, there was a disadvantage of having a low joining strength due to combining different kinds of materials, and there was therefore a problem in that the materials are easily peeled when external force acted on the materials or the materials were exposed to environments having large temperature variations. As efforts to solve the problem, a technique in which an oxide film on the surface of the secondary material which prevents good joining is removed by micronized catalyst in casting is performed. Alternatively, in producing cylinder heads for engines, oxide films on the surface of the secondary material are removed under vacuum, the surface is protected by plating with Ti-based thin film, and the secondary material is integrally cast with Al metal (see Japanese Laid-Open Patent No. 6-218519, specification (Page 1)).

In methods other than the chemical methods, in producing the cylinder bore portion of the cylinder block, cylinder liner is press fitted after casting Al alloy, whereby the combining is performed in a mechanically adhesive condition.

In the above-mentioned conventional composite material member, strength and durability in a joined part between constituent materials of the composite material member are firmly improved. However, all techniques have problems in that the production process is complicated or the material is expensive, whereby the cost is high. That is, micronized metals used as catalysts are precious metals such as Au, Ag and Pt. In a process in which Ti-based thin film is provided, cost is high due to performing in vapor phase by a PVD method. The combining by mechanical press fitting involves a finish processing at high accuracy of an internal diameter and an external diameter, and a press fitting process. Therefore, there was a problem in that production cost of the composite material member produced by these methods were high.

DISCLOSURE OF THE INVENTION

The present invention seeks to solve problems in the conventional techniques, and the purpose of the present invention is to provide a composite material member in which a main material is a light metal, strength and durability in a joined part between constituent materials of the composite material member are improved, and production cost is decreased, and to provide a method for producing the composite material member.

The present invention provides a composite material member containing a main material composed of a light metal or a light metal alloy which can be molded by casting and a secondary material composed of a metallic material different from the main material or an inorganic material, the secondary material being joined to the main material by integrally casting with the main material, and wherein a porous material is arranged on a part of a boundary area or entire boundary area between the main material and the secondary material.

In the composite material member, this light metal can be aluminum or magnesium, and the light metal alloy can be an alloy including at least one of aluminum and magnesium. Moreover, the secondary material can be cast iron, iron steel, stainless steel, Fe—Cr-based alloy, or Ni-based alloy.

In the composite material member having the composition, the porous material is fit in the main material, and is contacted with the secondary material at a boundary area with the secondary material. Therefore, the porous material is accordingly selected, whereby the porous material is joined to the secondary material by diffusion, thereby increasing a joining strength of a boundary face between the main material and the secondary material, and moderating thermal strain by making the thermal property in a portion including the porous material of the main material to be an intermediate property of that of the main material and that of the secondary material. These porous materials, such as stainless steel fiber are available at a low price.

Therefore, the porous material is preferably composed of a material which can be joined to the secondary material by diffusion, is more preferably composed of a metal fiber or a foamed metal produced by the material. According to this aspect, the porous material and the secondary material are sintered, thereby joining them by diffusion, resulting in obtaining further larger joining strength of the boundary face, and reducing the production cost by a simple process.

The metal fiber is laminated randomly or in an oriented condition, whereby the metal fiber can be a three-dimensional structure, and the porous material can be a whisker aggregate. Furthermore, the metal fiber and the whisker preferably have a wire diameter of from a few micrometers to a few millimeters, and the metal fiber and the whisker preferably have a grain size of from a few micrometers to a few millimeters. The metal fiber and the whisker more preferably have a wire diameter of from a few micrometers to 100 micrometers, and the metal fiber and the whisker more preferably have a grain size of from a few micrometers to 100 micrometers.

The porous material preferably has a volume rate of from 30 to 60% when a plate thickness in a direction spaced from the secondary material is not less than 1 mm and is less than 2 mm, and the porous material preferably has a volume rate of from 20 to 60% when a plate thickness in a direction spaced from the secondary material is not less than 2 mm. When the plate thickness is less than 1 mm, a layer having the intermediate thermal property is thin, whereby an action of moderating thermal strain between the secondary material and the main material is not sufficient.

Moreover, the porous material preferably has a volume rate of less than 30% when a plate thickness in a direction spaced from the secondary material is not less than 1 mm and is less than 2 mm, the absolute amount is small, whereby the thermal property in the portion including the porous material of the main material is not intermediate, and the action of moderating thermal strain between the secondary material and the main material is not sufficient. Furthermore, joining area by diffusion between the porous material and the secondary material is small, and the strength of the joining of the secondary material and the main material is not sufficient.

Furthermore, when the plate thickness is not less than 2 mm, the absolute amount of the porous material is increased, the lower limit of the volume rate can be allowed to be up to 20%. Therefore, when the volume rate is not less than 20%, the thermal property is intermediate, whereby the action of moderating thermal strain between the secondary material and the main material is sufficient. Furthermore, when the sintering is performed in a condition of putting the porous material on the secondary material, the joining area by diffusion between the porous material and the secondary material is increased by contraction of the porous material on the joining face by its own weight in the direction of the plate thickness, whereby the strength of the joining of the secondary material and the main material can be sufficient. As mentioned above, a strength which is sufficiently sustainable in use of thermal engine such as automobiles can be obtained.

In contrast, when the porous material has an excessive volume rate of more than 60%, it is difficult to impregnate the main material melted in the casting in the inner portion of the porous material, whereby the main material cannot completely reach the secondary material, resulting in decreasing contact area between the main material and the secondary material. Therefore, the area of diffusion joining is not sufficient, whereby it is difficult to increase the joining strength. Accordingly, it is preferable for the volume rate to be not more than 60%.

By setting the volume rate to be in the above-mentioned range, the porous material is set between the main material and the secondary material, whereby an action of moderating thermal strain between the secondary material and the main material can be obtained, and the contact area between the porous material and the secondary material is sufficiently increased, and the main material such as light metal is impregnated into the porous material, whereby the main material reaches the secondary material, resulting in obtaining an advantage of adhesion of the main material and the secondary material.

Furthermore, a volume rate of the porous material in the portion spaced from the secondary material is preferably set to be smaller than that in the portion close by the secondary material. According to the structure, the main material melted is easily impregnated into the porous material, and the contact area between the secondary material and porous material is increased, thereby increasing the area in diffusion joining.

In the above-mentioned case, the volume rate of the porous material is preferably from 20 to 70% when the plate thickness is not less than 1 mm. According to the structure, the contact area between the secondary material and the porous material is increased, whereby the joining area by diffusion can be preferably increased, and the main material such as the light metal is impregnated into the porous material, whereby the main material reaches the secondary material, preferably resulting in adhesion of the main material and the secondary material.

The present invention also provides a method for producing a composite material member containing the following steps of preparing a main material composed of a light metal or a light metal alloy which can be molded by casting, and a secondary material composed of a metallic material different from the main material or an inorganic material, and joining the secondary material to the main material by integrally casting the materials, wherein a porous material is contacted with the secondary material, the porous material and the secondary material are compressed at a predetermined volume rate and sintered in the contacted condition, thereby joining them by diffusion and obtaining a compact, and then the compact is joined to the main material by integrally casting them. According to the production method, a process of compressing the porous material and the secondary material, and a process of sintering the two materials can be organized.

The production method is also performed by using a diffusion joining process in which the porous material prelim nary compressed at a predetermined volume rate and the secondary material are sintered in a condition of contacting the two materials, in place of using a diffusion joining process in which the porous material and the secondary material are compressed at a predetermined volume rate and sintered in a condition of contacting the two materials. In this case, the sintering process is performed once and pressurization in sintering is not necessary when the porous material is composed of fiber, whereby a press die for the pressurization is not necessary and material volume is small, resulting in obtaining an advantage of high mass-production performance.

BEST MODE FOR CARRYING OUT THE INVENTION

Embodiments of the present invention will be explained hereinafter.

1. Production Samples

Figure 3:
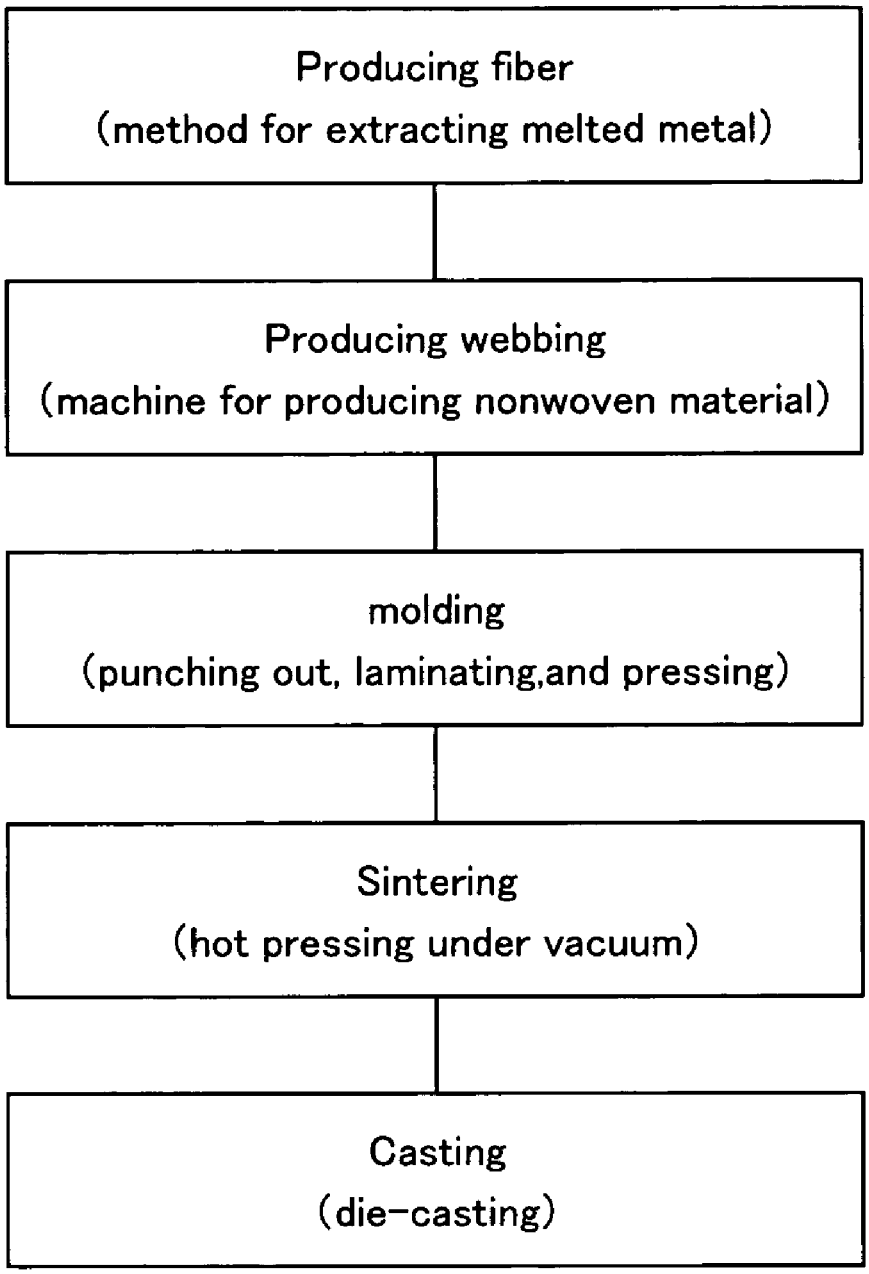
FIG. 3 is a procedural flow chart for producing a composite material member of the present invention.

A procedural flow chart for production samples No. 1 to 24 shown in Table 1 is shown in FIG. 3. First, by using a method for extracting melted metal disclosed in Japanese Patent Publication No. 3176833, fibers having a diameter of 40 μm were produced by using SUS 430, the obtained fibers were unwoven, whereby webbing having coating weight of 140 $g/m^2$ were produced. Directions of the fibers were randomly in a surface lamination direction. The webbings were punched out into a shape for testing by a pressing machine, and a predetermined number of the punched webbings were laminated, whereby laminated bodies were obtained. The laminated bodies were pressed so as to obtain porous materials having volume rates shown in Table 1. The volume rate (%) is a value showing compactness of the porous material which is shown by the following formula.

$$Vf=(\text{true volume}/\text{apparent volume})\times 100$$

TABLE 1

| | porous material specifications | | | evaluation result | | |
|---|---|---|---|---|---|---|
| Sample No. | material | plate thickness t(mm) | volume rate Vf (%) | impregnation performance | adhesion performance | boundary strength (Mpa) |
| Sample 1 | SUS 430 fiber | 0.5 | 50 | ○ | x | — |
| Sample 2 | SUS 430 fiber | 0.5 | 60 | ○ | x | — |
| Sample 3 | SUS 430 fiber | 0.5 | 70 | ○ | x | — |
| Sample 4 | SUS 430 fiber | 1 | 10 | ○ | x | — |
| Sample 5 | SUS 430 fiber | 1 | 20 | ○ | x | — |
| Sample 6 | SUS 430 fiber | 1 | 30 | ○ | ○ | 60 |
| Sample 7 | SUS 430 fiber | 1 | 40 | ○ | ○ | 75 |
| Sample 8 | SUS 430 fiber | 1 | 50 | ○ | ○ | 95 |
| Sample 9 | SUS 430 fiber | 1 | 60 | ○ | ○ | 140 |
| Sample 10 | SUS 430 fiber | 1 | 70 | x | — | — |
| Sample 11 | SUS 430 fiber | 2 | 10 | ○ | Δ | 20 |
| Sample 12 | SUS 430 fiber | 2 | 20 | ○ | ○ | 52 |
| Sample 13 | SUS 430 fiber | 2 | 30 | ○ | ○ | 66 |
| Sample 14 | SUS 430 fiber | 2 | 40 | ○ | ○ | 77 |
| Sample 15 | SUS 430 fiber | 2 | 50 | ○ | ○ | 100 |
| Sample 16 | SUS 430 fiber | 2 | 60 | Δ | ○ | 144 |
| Sample 17 | SUS 430 fiber | 2 | 70 | x | — | — |
| Sample 18 | SUS 430 fiber | 3 | 10 | ○ | Δ | 42 |
| Sample 19 | SUS 430 fiber | 3 | 20 | ○ | ○ | 64 |
| Sample 20 | SUS 430 fiber | 3 | 30 | ○ | ○ | 68 |
| Sample 21 | SUS 430 fiber | 3 | 40 | ○ | ○ | 84 |
| Sample 22 | SUS 430 fiber | 3 | 50 | Δ | ○ | 98 |
| Sample 23 | SUS 430 fiber | 3 | 60 | Δ | ○ | 146 |
| Sample 24 | SUS 430 fiber | 3 | 70 | x | — | — |
| Sample 25 | SUS 430 fiber 1 | 0.5 (main material side) | 20 | ○ | ○ | 122 |
| | | 0.5 (secondary material side) | 60 | | | |
| Sample 26 | SUS 430 fiber 1 | 0.5 (main material side) | 20 | ○ | ○ | 134 |
| | | 0.5 (secondary material side) | 70 | | | |
| Sample 27 | SUS 430 fiber 1 | 0.5 (main material side) | 20 | x | — | — |
| | | 0.5 (secondary material side) | 80 | | | |
| Sample 28 | Ni foamed metal | 2 | 20 | ○ | ○ | 44 |
| Sample 29 | Ni foamed metal | 2 | 40 | ○ | ○ | 65 |

Figure 4:
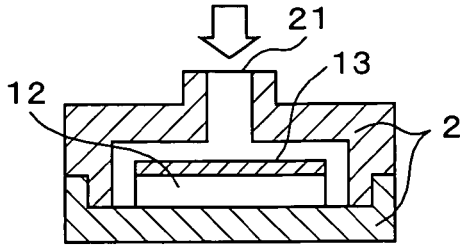
FIG. 4 is a sectional view showing a die for producing the test piece for estimation which is a composite material member of the present invention.

The porous materials preliminarily compressed at a volume rate shown in Table 1 were set on the SUS 430 used as the secondary material, and these materials were sintered at 1100° C. for 2 hours (by compression by its own weight) without loading in a vacuum furnace, whereby compacts were obtained. In this step, the secondary material and porous material, and the porous material and the porous material were joined by diffusion. The obtained compacts as mentioned above were preheated at 300° C., and were set on an undersurface of the die 2 shown in FIG. 4, and Al alloy ADC12 (JIS 2118) which was a main material was poured from a fill pot 21 of melted metal at 750° C. and 600 MPa, whereby test pieces of composite material member were produced (die-casting). According to the method, production efficiency is high since it is not necessary for the porous material to be sintered in a condition of pressing the material.

In the method for producing the samples 1 to 24, the process in which the porous material is preliminarily compressed can be omitted, and the porous material can be compressed in sintering of the porous material and the secondary material so as to obtain predetermined Vf.

The samples Nos. 25 to 27 were obtained by respectively sintering two kind of porous materials having different Vf in the step of obtaining predetermined Vf by pressing the porous materials, in producing method for the samples Nos. 1 to 24, and by sintering again in a condition of laminating the porous materials on the secondary material in descending order of Vf in the step of producing the compacts.

The samples Nos. 28 and 29 were obtained by using Ni foamed metal having a coating weight of 140 g/m$^2$ (Cermet, produced by Sumitomo Electric Industries, Ltd.) and by performing of molding, sintering, and casting shown in the FIG. 3. Reference character "t" in FIGS. 5 and 6 denotes the plate thickness of each sample.

2. Examination Contents

Figure 5:
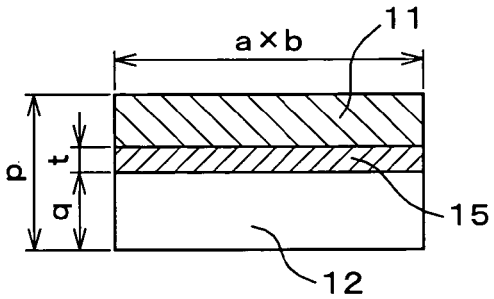
FIG. 5 is a sectional view showing a test piece for estimating impregnation performance and adhesion performance of the composite material member of the present invention.

Impregnation performance, adhesion performance, and boundary strength were estimated at three levels. FIG. 5 shows a specifications of the test piece for estimation of impregnation performance and adhesion performance, and a=20 mm, b=100 mm, P=30 mm, and q=15 mm in FIG. 5.

The impregnation performance means an estimated performance which shows a degree of impregnating the porous material into the main material and is observed by scanning Electron Microscopy (SEM).

The adhesion performance means an estimated performance in which the presence of interstitial spaces in the boundary face between the secondary material and the main material is estimated, and the adhesion performance was observed by SEM.

The joining strength at the boundary face was estimated by joining strength at the boundary face between the secondary material and the main material by a shearing test.

Figure 6:
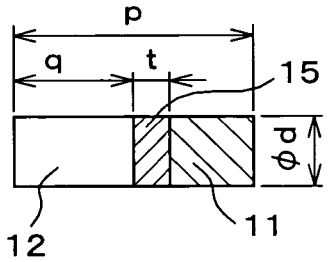
FIG. 6 is a sectional view showing a test piece for estimating boundary strength of the composite material member of the present invention.
Figure 7:
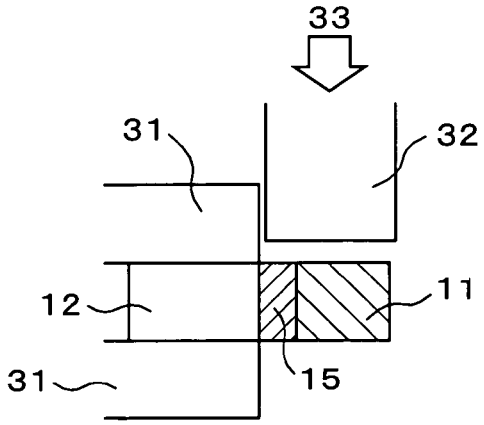
FIG. 7 is a sectional view showing an embodiment for a testing method for estimating boundary strength of the composite material member of the present invention.

FIG. 7 shows an embodiment for a method for a shearing test in which a test piece of a composite material member having a shape shown in FIG. 6 is held between parts of a fixed jig 31, and a shearing jig 32 is moved in the pressurization direction 33 at 0.5 mm/min, whereby shearing stress is measured, and the measured value is considered as the joining strength in the boundary face.

3. Test Result

The test result is shown in Table 1. The meaning of the symbols in the estimation result column will be explained hereinafter.

The impregnation performance was estimated at three levels.

○: excellent impregnation performance (the main material was completely impregnated up to the boundary face between the secondary material and the main material.)

Δ: defective impregnation performance in a part (although the main material was impregnated up to the boundary face between the secondary material and the main material, there are cavities in a part of the composite portion with the porous material. However, the presence of the cavities is within an allowable range.)

X: defective impregnation performance (the main material was not impregnated up to the boundary face between the secondary material and the main material.)

The adhesion performance was estimated at three levels.

○: excellent adhesion performance (the secondary material and the main material are completely adhered.)

Δ: defective adhesion performance in a part (interstitial spaces between the secondary material and the main material exist places. However, the presence of the interstitial spaces is within an allowable range.)

X: defective adhesion performance (interstitial spaces between the secondary material and the main material exist.)

4. Estimation

Figure 1:
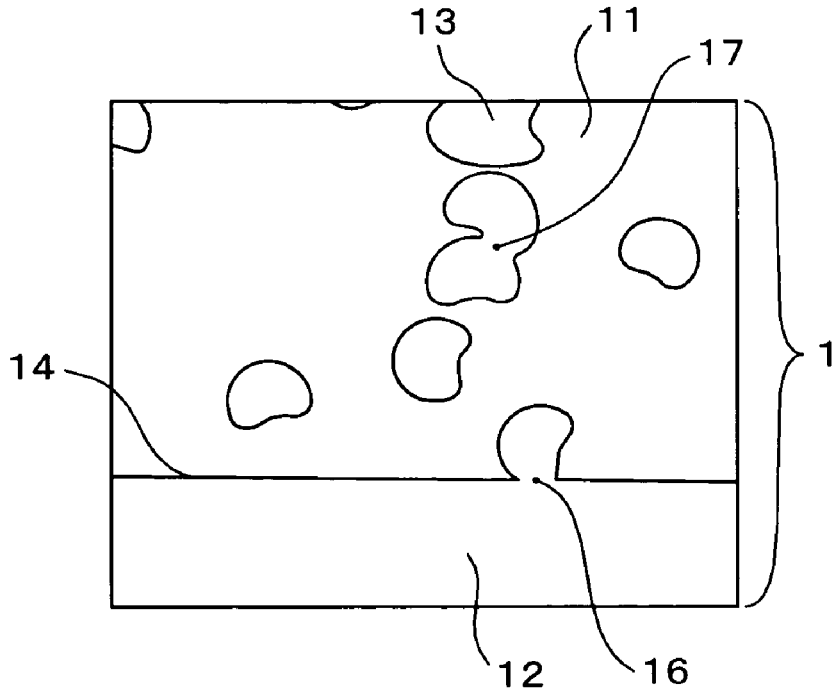
FIG. 1 is a sectional view showing an embodiment of the present invention.

FIG. 1 is a sectional view showing an example of the composite material member 1 of an embodiment of the present invention. In the construction of the composite material member shown in FIG. 1, a main material 11 (SUS 430) and a secondary material 12 (ADC 12) are joined on the joining portion 14, and metal fibers 13 (SUS 430) are arranged in the boundary portion. It was confirmed that the secondary material 12 and the metal fiber 17 were joined by diffusion in diffusion joining portion 16, and metal fiber 13 and metal fiber 13 were joined by diffusion in diffusion joining portion 17.

Figure 2:
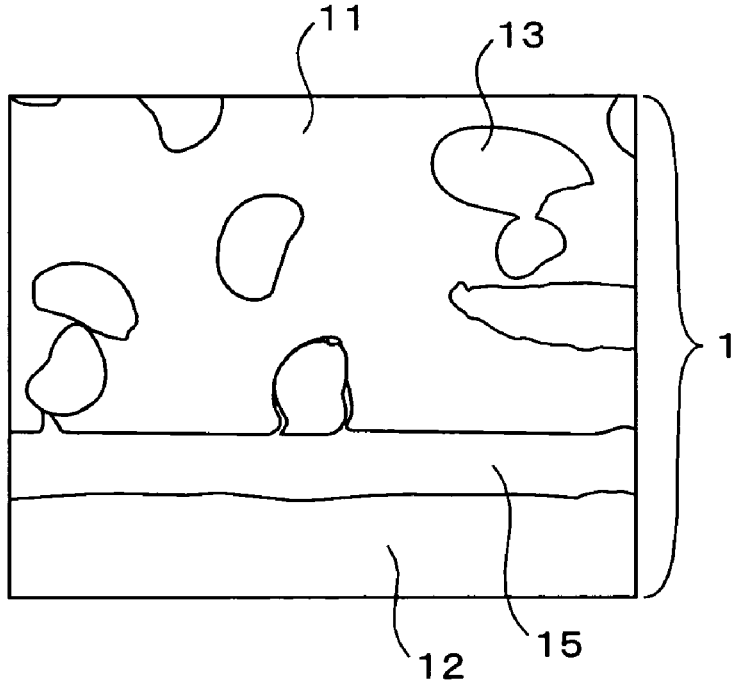
FIG. 2 is a sectional view showing an embodiment of the present invention after a shear test.

FIG. 2 is a sectional view showing an example of the composite material member 1 of an embodiment of the present invention similar to the example shown in FIG. 1. In the example shown in the FIG. 2, interstitial space 15 occurs by peeling the boundary face 14. The condition of the boundary face is defined as the defective adhesion. The interstitial space 15 occurs by peeling the boundary face due to large strain based on difference in coefficient of thermal expansion.

Figure 8:
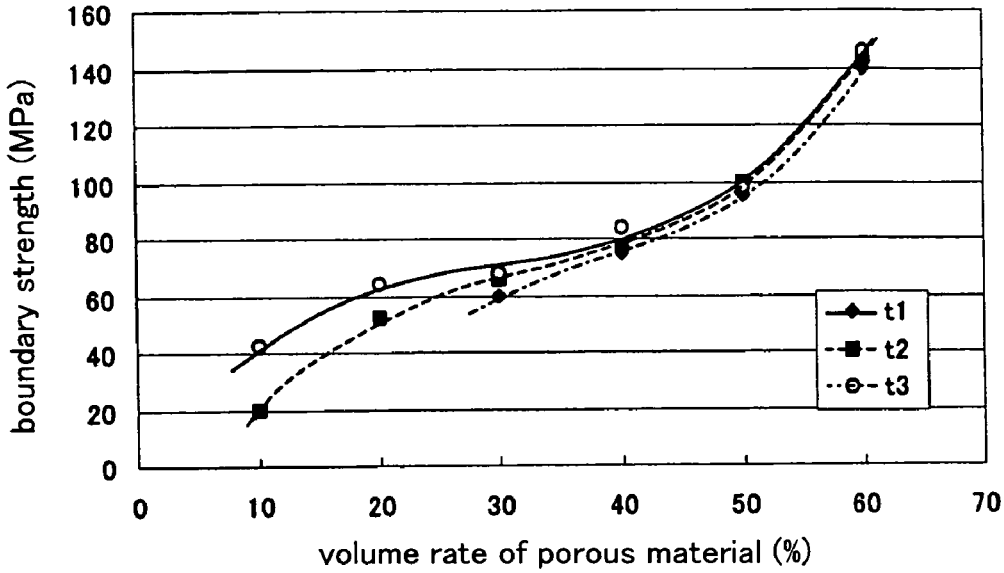
FIG. 8 is a graph showing relationships between the boundary strength and the volume rate of the porous material.

The samples Nos. 1 to 24 are a sample group having common point in which Vf of porous material is uniform in the same sample. Influence for the boundary strength in the case of changing the plate thickness and the Vf of these samples is shown in FIG. 8. In FIG. 8, t1=1 mm, t2=2 mm, and t3=3 mm in the plate thickness. As for comparison of the influence of the plate thickness, when the plate thickness is greater, the boundary strength is obviously larger in a range of Vf of not more than 40. However, if the plate thickness is greater, the boundary strength is not obviously larger as well in range of Vf of not less than 50. As for the influence of the Vf, when the Vf is larger, the boundary strength is obviously larger. Judging from these tendencies, when the boundary strength must be increased, Vf is increased. However, increasing the plate thickness is effective for the boundary strength in range of a small Vf (less than 30), and the increasing the plate thickness is not effective for the boundary strength in a range of a large Vf. Therefore, it is confirmed that the closest element for the boundary strength is Vf in the vicinity of the joining face, and when the plate thickness is not less than 1 mm and less than 2 mm, Vf is necessarily 30 at a minimum, and when Vf is larger, the boundary strength is larger, and when the Vf in the vicinity of the joining face is further smaller (not less than 20), the small Vf can be covered by the plate thickness (not less than 2 mm). However, in contrast, it is confirmed that when the Vf is set to be not less than 70, high impregnation performance and adhesion performance cannot be obtained (samples Nos. 10, 17, and 24), and casting cannot be preferably performed. This is because when the Vf is excessively increased, it is difficult for the main material to impregnate into the porous material in casting in the producing conditions. Moreover, the plate thickness is excessively small such as less than 1 mm (samples Nos. 1 to 3), it is confirmed that even when the Vf is increased, the effect of existence of the porous material in the boundary area between the main material and the secondary material is not apparent. Therefore, it is confirmed that, in the porous material of the present invention, when the plate thickness is not less than 1 mm and less than 2 mm, preferable boundary strength can be obtained in the case of setting the Vf to be 30 to 60, and when the plate thickness is not less than 2 mm, desirable boundary strength can be obtained in the case of setting the Vf to be 20 to 60.

The samples Nos. 25 to 27 are obtained by laminating 2 kinds of the porous materials having different Vf. In these examples, conflicting performances of high impregnation performance of the main material in casting in the case of small Vf and high boundary strength in the case of large Vf are balanced. Even when the whole plate thickness is 1 mm, preferable boundary strength can be obtained. For example, in sample No. 25, the average of Vf is 40, and the boundary strength (122 MPa) of the sample No. 25 is 1.6 times of that (75 MPa) of the sample No. 7 which has corresponding plate thickness of 1 mm and Vf of 40. However, the Vf exceeds 80, defective impregnation occurs in the condition of the producing condition.

The samples Nos. 28 and 29 are obtained by using foamed metal as a porous material. The boundary strengths of the samples Nos. 28 and 29 are lower than those of the samples Nos. 12 and 14 having plate thickness and Vf equal to those of the samples Nos. 28 and 29. Because mesh of the foamed metal is coarse and the secondary materials are different between the samples Nos. 12 and 14 and the samples Nos. 28 and 29.

5. Changed Example

Light metal which is the main material of the present invention means aluminum, magnesium, alloy made of at least one of these metals and another metal. However, the light metal is not limited in the range of the above-mentioned metal and alloy.

The secondary material of the present invention can be any material which can cover the problems of the light metal. For example, when mechanical strength such as tension, compression, shear, and friction must be covered, it is preferable for the secondary material to use cast iron, iron steel, stainless steel, Fe—Cr-based alloy, Ni-based alloy. When the thermal strength must be covered, it is preferably for the secondary material to use various ceramics. However, the secondary material is not limited in the range of the above-mentioned material.

As property of the porous material of the present invention, it is preferably to join the porous material and the porous material, and further porous material and the secondary material for diffusion. However, the property of the porous material is not limited in the range of the above-mentioned property. Any porous material having properties in which the porous material and the secondary material can be joined by binding or brazing can be used. As the thermal property, coefficient of thermal expansion of the porous material is preferably equal to that of the secondary material. Therefore, the porous material is more preferably composed of the same material of the secondary material.

In the samples Nos. 1 to 5, thermal strain cannot be completely moderated in the producing condition, whereby the defective adhesion is observed. In another producing condition in which pressure is held for about 2 minutes after injection of melted metal, and pressure is also applied in the quenching, the adhesion performance is improved, and test pieces having preferable joining face can be obtained. Additionally, in these methods, it is inevitable that production facilities are expensive and the production process is time consuming.

In the samples Nos. 10, 17, and 24, defective impregnation occurs. However, test pieces having preferable impregnation performance can be obtained by preheating the compact to 700° C. or increasing pressure for pouring the melted metal at 100 MPa. Additionally, these preprocessing and casting conditions bring high production cost.

The invention claimed is:

1. A composite material member comprising:

a main material composed of a light metal or a light metal alloy which can be molded by casting; and a secondary material joined to the main material by integrally casting with the main material, wherein a porous material is arranged on a part of a boundary area or an entire boundary area between the main material and the secondary material, wherein the light metal is aluminum or magnesium, and the light metal alloy is an alloy including at least one of aluminum and magnesium, wherein the secondary material is cast iron, iron steel, stainless steel, Fe—Cr-based alloy, Ni-based alloy, or ceramic, wherein the porous material is composed of a metal fiber or a foamed metal by which a diffusion joining can be performed with the secondary material, and wherein in the case in which the porous material has a single layer structure, the porous material is composed of a single material which has a volume rate that is from 30 to 60% when a plate thickness of a portion of the porous material which contacts the secondary material in a direction spaced from the secondary material is not less than 1 mm and less than 2 mm, and the porous material has a volume rate that is from 20 to 60% when a plate thickness of a portion of the porous material which contacts the secondary material in a direction spaced from the secondary material is not less than 2 mm, and in a case in which the porous material has a double layer structure having a first layer proximate to the secondary material and a second layer proximate to the main material, the first layer of the porous material has a plate thickness of 0.5 mm and a volume rate of 60 to 70%, and the second layer of the porous material has a plate thickness of 0.5 mm and a volume rate of 20%.

2. The composite material member according to claim 1, wherein the metal fiber is laminated randomly or in an oriented condition to yield a three-dimensional structure.

3. The composite material member according to claim 1, wherein the metal fiber has a wire diameter of from a few micrometers to 100 micrometers, and the metal fiber has a grain size of from a few micrometers to 100 micrometers.

4. A method for producing a composite material member comprising the steps of preparing a main material composed of a light metal or a light metal alloy which can be molded by casting, and a secondary material composed of a metallic material different from the main material, or a ceramic; and joining the secondary material to the main material by integrally casting the materials;

wherein a porous material is contacted with the secondary material, the porous material and the secondary material are compressed at a predetermined volume rate and sintered in the contacted condition to join them by diffusion and obtaining a compact, and the compact is joined to the main material by integrally casting them; and wherein in a case in which the porous material has a single layer structure, the porous material is composed of a single material which has a volume rate that is from 30 to 60% when a plate thickness of a portion of the porous material which contacts the secondary material in a direction spaced from the secondary material is not less than 1 mm and less than 2 mm, and the porous material has a volume rate that is from 20 to 60% when a plate thickness of a portion of the porous material which contacts the secondary material in a direction spaced from the secondary material is not less than 2 mm, and in a case in which the porous material has a double layer structure having a first layer proximate to the secondary material and a second layer proximate to the main material, the first layer of the porous material has a plate thickness of 0.5 mm and a volume rate of 60 to 70%, and the second layer of the porous material has a plate thickness of 0.5 mm and a volume rate of 20%.

5. A method for producing a composite material member comprising the steps of preparing a main material composed of a light metal or a light metal alloy which can be molded by casting, and a secondary material composed of a metallic material different from the main material, or a ceramic; and joining the secondary material to the main material by integrally casting the materials;

wherein a porous material composed of a fiber is preliminarily compressed at a predetermined volume rate, the compressed fiber and the secondary material are sintered, thereby joining them by diffusion and obtaining a compact, and the compact is joined to the main material by integrally casting them, and wherein in a case in which the porous material has a single layer structure, the porous material has a volume rate that is from 30 to 60% when a plate thickness of a portion of the porous material which contacts a secondary material in a direction spaced from the secondary material is not less than 1 mm and less than 2 mm, and the porous material is composed of a single material which has a volume rate that is from 20 to 60% when a plate thickness of a portion of the porous material which contacts the secondary material in a direction spaced from the secondary material is not less than 2 mm; and in a case in which the porous material has a double layer structure having a first layer proximate to the secondary material and a second layer proximate to the main material, the first layer of the porous material has a plate thickness of 0.5 mm and a volume rate of 60 to 70%, and the second layer of the porous material has a plate thickness of 0.5 mm and a volume rate of 20%.

* * * * *